US009062869B2

(12) United States Patent
Lay et al.

(10) Patent No.: US 9,062,869 B2
(45) Date of Patent: Jun. 23, 2015

(54) LIGHTING APPARATUS WITH MOUNTING BRACKET, AND METHOD

(71) Applicant: Cree, Inc., Durham, NC (US)

(72) Inventors: James Michael Lay, Apex, NC (US); William L. Dungan, Cary, NC (US)

(73) Assignee: Cree, Inc., Durham, NC (US)

( * ) Notice: Subject to any disclaimer, the term of this patent is extended or adjusted under 35 U.S.C. 154(b) by 125 days.

(21) Appl. No.: 13/842,557

(22) Filed: Mar. 15, 2013

(65) Prior Publication Data

US 2014/0268825 A1 Sep. 18, 2014

(51) Int. Cl.
*F21V 11/00* (2006.01)
*F21V 21/03* (2006.01)

(52) U.S. Cl.
CPC ..... *F21V 21/03* (2013.01); *Y10T 29/49826* (2015.01)

(58) Field of Classification Search
CPC ..... B65D 43/0222; B65D 43/0287; B65D 43/0231; B65D 43/285; B65D 43/283; B65D 43/277; B65D 50/04; B65D 50/046; B65D 50/045; B65D 45/28; A47B 96/06; A47B 29/00; A47B 1/00; F21V 21/00; F21V 35/00; A47G 29/02
USPC ..... 362/368, 404; 248/220.22, 221.11, 248/222.13, 222.52, 343, 293, 306, 301, 248/302
See application file for complete search history.

(56) References Cited

U.S. PATENT DOCUMENTS

| | | | | | |
|---|---|---|---|---|---|
| 1,507,758 | A * | 9/1924 | Scott | 362/404 |
| 1,661,188 | A * | 3/1928 | Matthews | 248/221.12 |
| 2,132,784 | A * | 10/1938 | Guth | 362/404 |
| 2,491,376 | A * | 12/1949 | Hartman | 362/438 |
| 2,835,791 | A * | 5/1958 | Horwitz | 362/366 |
| 3,019,931 | A * | 2/1962 | Thornton | 220/288 |
| 3,101,856 | A * | 8/1963 | Whiteman, Jr. | 220/288 |
| 3,422,978 | A * | 1/1969 | Quackenbush | 215/216 |
| 3,524,981 | A * | 8/1970 | Auerbach | 362/433 |
| 3,830,391 | A * | 8/1974 | Uhlig | 215/216 |
| 4,500,006 | A * | 2/1985 | Lafortune et al. | 220/281 |
| 4,507,719 | A * | 3/1985 | Quiogue | 362/404 |
| 4,636,926 | A * | 1/1987 | Roberge | 362/353 |
| 4,754,383 | A * | 6/1988 | Klaus | 362/363 |
| 5,460,281 | A * | 10/1995 | Rapchak et al. | 215/216 |
| 6,039,196 | A * | 3/2000 | Ekkert et al. | 215/216 |
| 6,244,736 | B1 * | 6/2001 | O'Neal | 362/368 |
| 6,293,510 | B1 | 9/2001 | Bradford et al. | |
| 6,398,179 | B1 * | 6/2002 | Soles | 248/617 |
| 6,669,159 | B1 * | 12/2003 | Hsu | 362/404 |

(Continued)

OTHER PUBLICATIONS

Kim Lighting, Parking Structure PGL7 LED, "The Next Generation of Parking Structure Lighting", Version 2.3 (Aug. 2012), available at: http://www.kimlighting.com/content/products/literature/literature_files/k1_pg17led_lit.pdf, (24 pages), printed on Apr. 26, 2013.

(Continued)

*Primary Examiner* — Ismael Negron
(74) *Attorney, Agent, or Firm* — McCracken & Gillen LLC

(57) ABSTRACT

A lighting apparatus has an upper housing assembly and at least one additional housing assembly. The upper housing assembly has a top wall and at least one sidewall. The top wall includes a mounting portion with mounting brackets that are configured to attach to respective extension members when the lighting apparatus is rotated into a locking arrangement, with the mounting plate.

25 Claims, 7 Drawing Sheets

(56) References Cited

U.S. PATENT DOCUMENTS

| | | | | |
|---|---|---|---|---|
| 6,726,348 | B2 | 4/2004 | Gloisten | |
| 7,063,445 | B2 * | 6/2006 | Wang et al. | 362/368 |
| 8,622,590 | B2 * | 1/2014 | Cheng | 362/368 |
| 8,684,569 | B2 * | 4/2014 | Pickard et al. | 362/365 |
| 8,689,995 | B2 * | 4/2014 | Letica et al. | 220/298 |
| 8,777,032 | B2 * | 7/2014 | Biesecker et al. | 220/281 |
| 2010/0315252 | A1 | 12/2010 | Desphande et al. | |
| 2011/0261572 | A1 * | 10/2011 | Watanabe et al. | 362/373 |
| 2013/0334164 | A1 * | 12/2013 | Kassouni | 215/330 |

OTHER PUBLICATIONS

International Search Report and Written Opinion dated Jul. 18, 2014, for International Application No. PCT/US2014/027344, Applicant, Cree, Inc, (19 pages).

* cited by examiner

LIGHTING APPARATUS WITH MOUNTING BRACKET, AND METHOD

CROSS-REFERENCE TO RELATED APPLICATIONS

Not Applicable

REFERENCE REGARDING FEDERALLY SPONSORED RESEARCH OR DEVELOPMENT

Not Applicable

BACKGROUND OF THE INVENTION

1. Field of Invention

The present invention generally relates to a lighting apparatus. More particularly, the present invention relates to a mounting and locking mechanism for a lighting apparatus.

2. Description of the Background of the Invention

It can be awkward mounting a lighting apparatus to a ceiling or wall, especially in structures with high ceilings and wall mounts such as parking garages. First, electrical wiring has to be run from the ceiling or wall mount into the lighting apparatus. Then an installer must attach the lighting apparatus to the ceiling or wall mount. Often times it can be difficult to run wires from the ceiling or wall mount into the lighting apparatus before it is mounted. It is desirable that the lighting apparatus be positioned near the ceiling or wall mounting when the wiring is performed. If the lighting apparatus is not mounted, the installer often must hold the lighting apparatus and attempt to run wiring at the same time.

Installation or maintenance of a lighting apparatus often requires the need for separate mounting tools and components. Unfortunately, screws or other mounting components may be dropped onto the floor or into the luminaire. Additional tools such as screwdrivers may also be dropped and accidentally cause damage to the lighting fixture, especially if the installer must hold the lighting apparatus in one hand while operating tools in the other hand.

Certain lighting systems may employ a strap with a hooked portion that is hinged to one end of the lighting apparatus. The strap may be used to hang the lighting apparatus from one side of a mounting plate. The suspension strap may also be used to swing the lighting apparatus up for securement with the mounting plate. Such lighting systems are, however, limited. For instance, the single hinge point of the strap may often endure significant stress to support the full weight of the lighting apparatus while it is hanging. This stress may be exacerbated during long installations. If the strap breaks the lighting apparatus may be damaged or destroyed. Additionally, without the strap it may be significantly more difficult to install the lighting apparatus. Accordingly, there is a need for a lighting apparatus that may be mounted and locked into place in a safe, easy, and efficient manner without the need for separate tools and mounting components.

SUMMARY

According to one aspect of the present invention, a lighting apparatus, comprises an upper housing assembly having a top wall and at least one sidewall, at least one additional housing assembly positioned below and secured to the upper housing assembly, and a mounting portion at the top wall of the upper housing assembly. The upper housing assembly has a conduit configured to receive electrical wiring to the lighting apparatus. The mounting portion is configured to rotatably attach to a mounting plate.

According to another aspect of the present invention, a mounting and locking system for a lighting apparatus is configured to be attached to an electrical junction box extending from a ceiling or wall. The mounting and locking system comprises a mounting plate having a plurality of extension members extending from a bottom face of the mounting plate and a lighting apparatus having an upper housing assembly and at least one additional housing assembly positioned below and secured to the upper housing assembly. The upper housing assembly has a top wall and at least one sidewall. The top wall includes a mounting portion having a plurality of mounting brackets. The mounting brackets are configured to attach to respective extension members when the lighting apparatus is rotated into a locking arrangement with the mounting plate.

In yet another aspect of the present invention a dual mounting and locking method of installing a lighting apparatus to a support structure is provided. A mounting portion of an upper housing assembly of the lighting apparatus is aligned with a mounting plate. The upper housing assembly is rotated in one direction to mount the mounting portion to the mounting plate. A locking mechanism of the upper housing assembly is moved to a locked position when the upper housing assembly is rotated to mount the mounting portion.

DETAILED DESCRIPTION OF THE INVENTION

Figure 1:
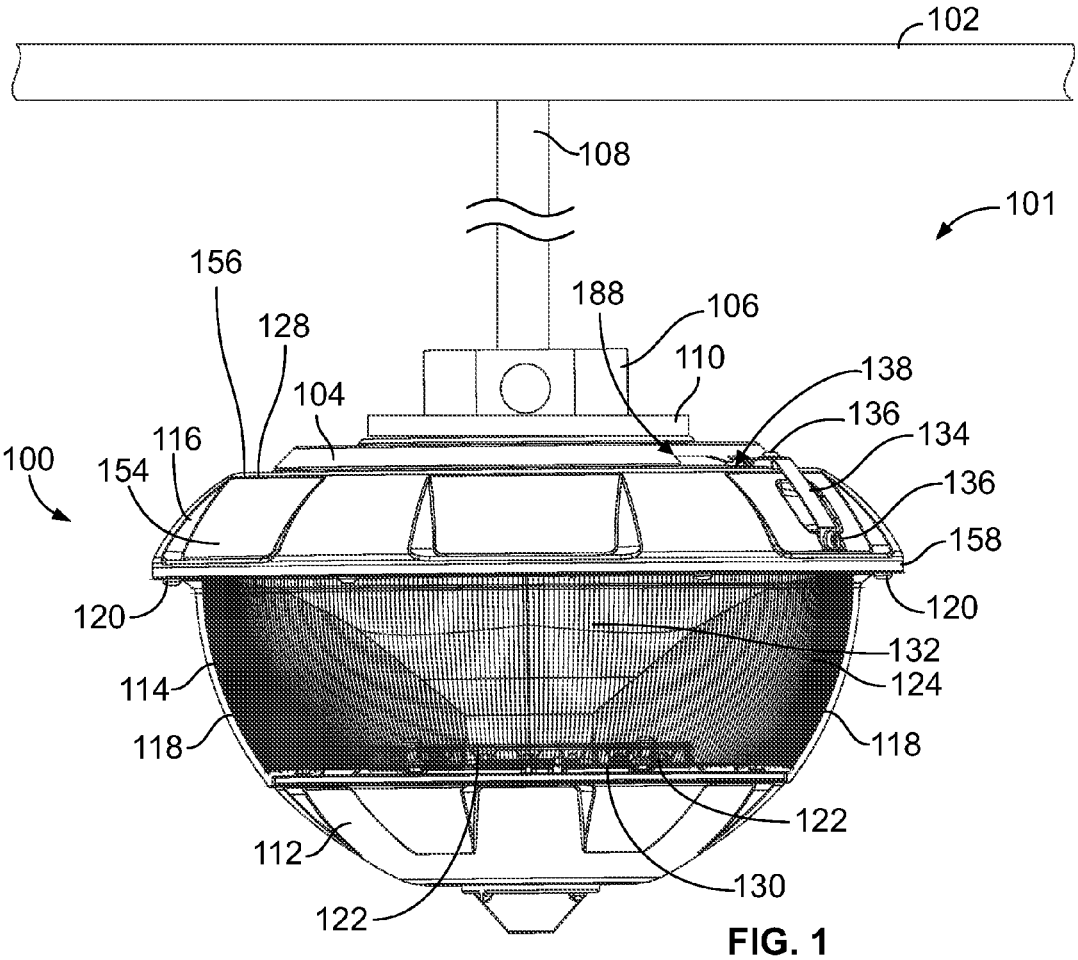
FIG. 1 is a front plan view of a lighting apparatus hanging from a wall or ceiling mount according to an embodiment of the present invention.

As seen in FIG. 1, a lighting apparatus 100 of a mounting and locking system 101 is configured to be mounted to a ceiling 102, or other support structure such as a wall. In this example, the lighting apparatus 100 is securable to an annular mounting plate 104. The mounting plate 104 may be attached to a junction box 106 by screws, for example. The junction box 106 may be attached to the ceiling 102 by support post 108 or other suitable mounting structures known to those of ordinary skill in the art. Electrical wiring 109 to provide power to the lighting apparatus 100 may be run from the ceiling 102 or wall through the support post 108 to the junction box 106. The example shown in FIG. 1 may be a pendant mount arrangement with the junction box 106 connected to a support structure 102 at a short distance by a support post 108. Alternatively, direct mount arrangements of the lighting apparatus 100 may be used in which the junction box 106 is positioned within and flush with the ceiling or abuts against the ceiling or other support structure 102 (see FIG. 9). Electrical wiring 109 coupled with electrical components of the lighting apparatus 100 may also extend from the lighting apparatus 100 to the junction box 106 to allow for electrical connections within the junction box 106 required for operation of the lighting apparatus 100 (See FIGS. 3 and 8). A gasket 110, FIG. 1, may also be used to provide a seal at the juncture of the mounting plate 104 and the junction box 106 such that the gasket 110 is positioned on an upper surface of the mounting plate 104 and surrounding a lower portion of the junction box 106.

Figure 2:
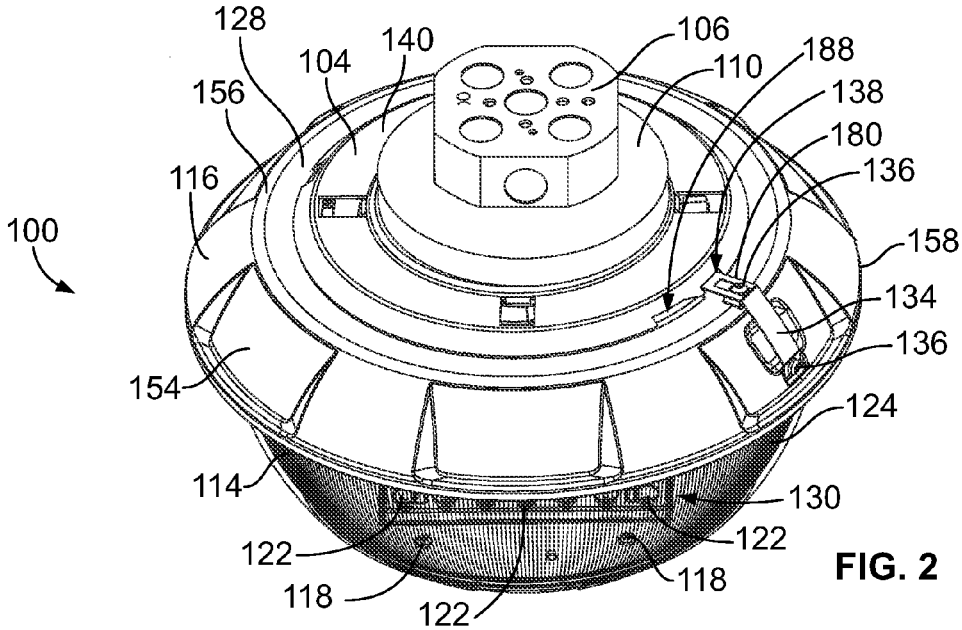
FIG. 2 is a top perspective view of a junction box and a mounting plate attached to the lighting apparatus.

As seen in FIGS. 1 and 2, the lighting apparatus 100, in this example, includes a lower housing assembly 112, a middle housing assembly 114, and an upper housing assembly 116. The lower housing assembly 112 may be secured to the middle housing assembly 114 by screws 118, and the middle housing assembly 114 may be secured to the upper housing assembly 116 by screws 120, for example. Alternative approaches to connect the housing assemblies 112, 114, 116 may selectively be employed. The lower housing assembly 112 may contain light emitting diodes (LEDs) 122 used for illumination of the lighting apparatus 100. The middle housing assembly 114, in this example, includes an outer lens 124 configured to focus light emitted from the LEDs 122. The upper housing assembly 116 may house electrical components such as a driver to control the LEDs 122. Other electrical components such as, for example, a transformer, a surge protector, or a current limiter may also selectively be housed at the upper housing assembly 116. The electrical components may be coupled to electrical wiring 109 that extends from a conduit 126 centrally positioned at a top wall 128 of the upper housing assembly 116 (as seen, for example, in FIG. 3). The upper housing assembly 116 and lower housing assembly 112 may be formed from die cast aluminum or other suitable material. The lens 124 of the middle housing assembly 114, for example, may be an acrylic lens. In alternative embodiments, the middle housing assembly 114 and lower housing assembly 112 may be joined together into one assembly or further divided into more assemblies.

The LEDs 122 of lighting apparatus 100 may be collectively retained with in a lighting module 130 (as seen in FIGS. 1 and 2), or individually retained within the lighting apparatus 100. The LEDs 122 and the lighting module 130 may be disposed within the lower housing assembly 112 with the LEDs 122 extending into the middle housing assembly for transmission of light off an internal reflector 132 (FIG. 1). In alternative embodiments, the LEDs 122 and lighting module 130 may be arranged in different portions of the lighting apparatus 100.

The upper housing assembly 116 also includes a locking mechanism 134. The locking mechanism 134 in this example may be a locking bracket attached to the upper housing assembly 116 by screws 136 or other suitable attachment means. The locking bracket 134 extends into a locking opening 138 at the outer edge of the mounting plate 104 when the lighting apparatus 100 is rotatably attached to the mounting plate 104 in order to lock the lighting apparatus 100 in place and prohibit the lighting apparatus 100 from being removed from the mounting plate 104.

Figure 3:
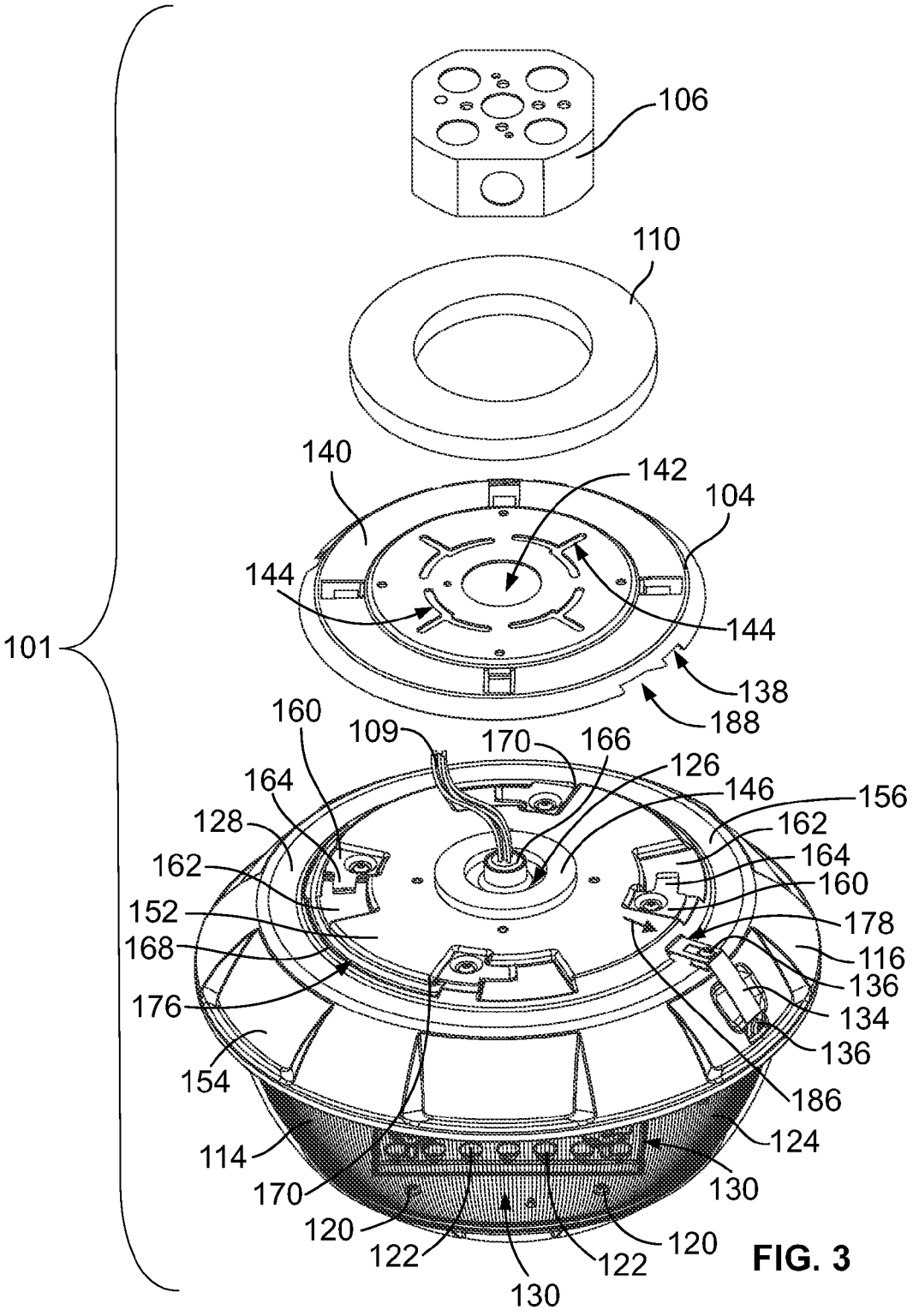
FIG. 3 is an exploded top perspective view of the junction box, the mounting plate, and the lighting apparatus.

Referring now to FIG. 3, an exploded view of the mounting and locking system 101 for the lighting apparatus 100 configured for attachment to electrical junction box 106 is shown. The mounting plate 104 may be attached, for example, to an under side of the junction box 106 by a series of screws (not shown). Gasket 110 is positioned to surround the lower portion of the junction box 106 and provide a seal between the junction box 106 and upper side 140 of the mounting plate 104. The mounting plate 104 includes various slots 144 providing for narrow openings completely through the upper side 140 of the mounting plate 104. Screws may be inserted through the slot openings 144 and screwed into place on the under side of the junction box 106. In this example, the slots 144 through the mounting plate 104 have a chicken feet shape to allow for attachment to different model types of junction boxes potentially having different positioned screw receiving slots.

As seen in FIG. 3, another gasket 146 may be placed around a central conduit 126 on a top wall 128 of the upper housing assembly 116 of the lighting apparatus 100. The lighting apparatus 100, in this example, may be configured to be rated IP66, which allows for power washing to eliminate dust and pollutants. Having both gasket 110 and gasket 146 provides a tight water seal between the junction box 106, the mounting plate 104 and the lighting apparatus 100 so as to prevent water used during power washing from entering the lighting apparatus 100, thereby reducing the risk of potential damage to electrical wiring 109 or components.

Figure 4:
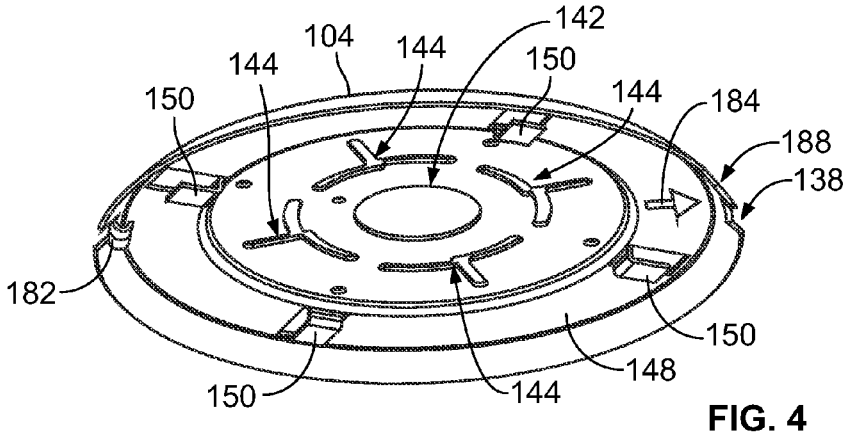
FIG. 4 is a lower perspective view of the mounting plate.

Referring to FIGS. 3 and 4, the mounting plate 104 has a channel 142 through the mounting plate 104 which allows for electrical wiring 109 to be run from the junction box 106. The channel 142, for example, may be annular in shape and positioned proximate to or at the center of the mounting plate 104. Different shapes or positioning of the channel of the mounting plate 104 may be employed in alternative arrangements. Extending from a bottom face 148 of the mounting plate 104 are extension members 150. The extension members 150 are configured to attach to a mounting portion 152 at the top wall 128 of the upper housing assembly 116 of the lighting apparatus 100. In this example, the extension members 150 are L-shaped members extending down from the bottom face 148 of the mounting plate 104, with the open end of the "L" shape facing radially outwards. In alternative embodiments, the open end of the L-shaped extension members may face radially inwards, or alternatively, the extension members may be configured as a J-shaped hook, a U-shaped hook, or other structural arrangement.

Figure 5:
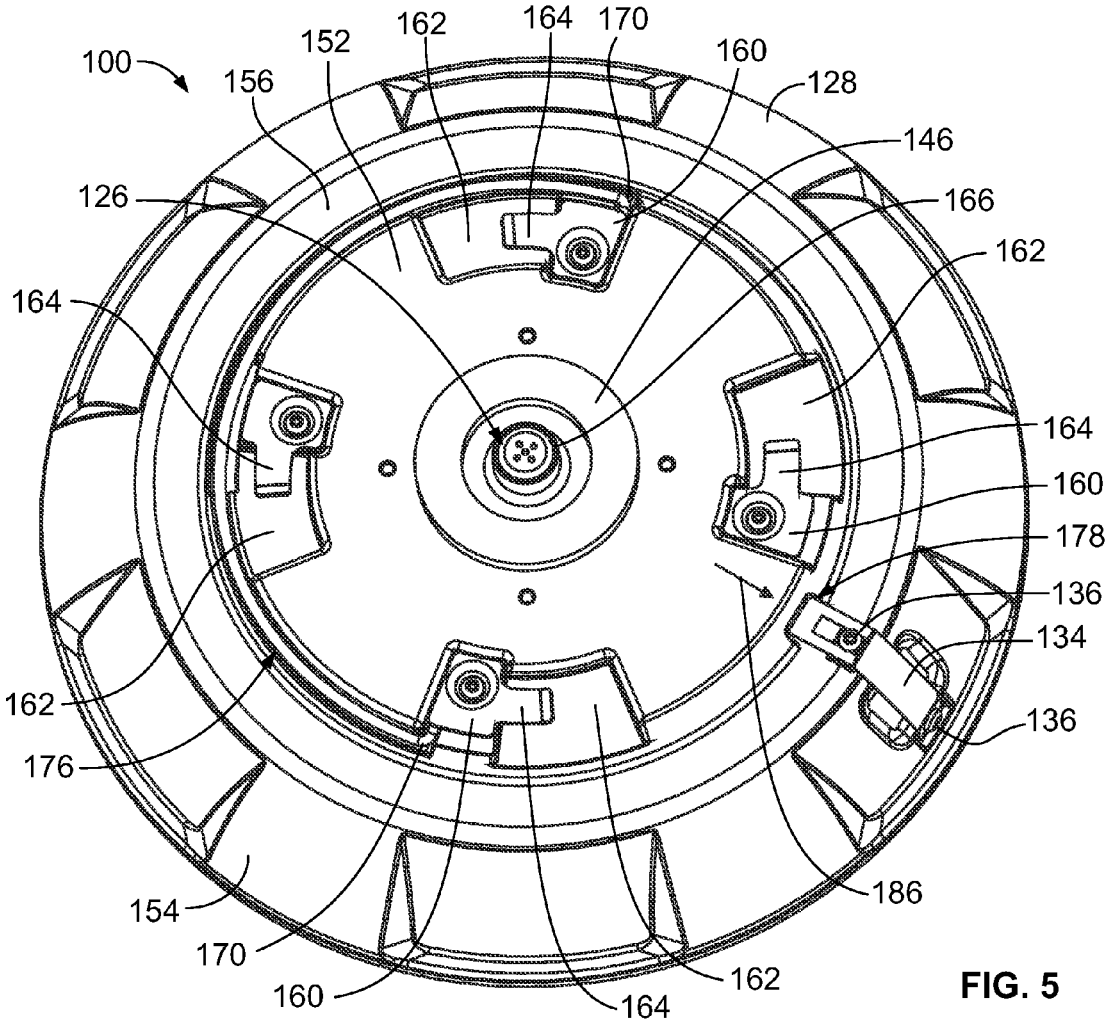
FIG. 5 is a top plan view of the upper housing assembly of the lighting apparatus.

As seen in FIGS. 3 and 5, the upper housing assembly 116 of the lighting apparatus 100 includes a top wall 128 and sidewalls 154. An outer portion 156 of the top wall 128, in this example, is substantially annular. In this example, the sidewalls 154 curve downward and outward from the outer portion 156 of the top wall 128, terminating at a bottom rim 158 that has a larger radius and circumference than the outer portion 156. In alternative embodiments, the outer portion 156 may have a larger radius and circumference than the bottom rim 158 or both the outer portion 156 and the bottom rim 158 may have substantially the same radius or circumference.

Radially inward from the outer portion 156 of the top wall 128 of the upper mounting assembly 116 is a mounting portion 152. The mounting portion 152 is configured to rotatably attach to the mounting plate 104. The mounting portion 152 is also substantially annular and is elevated above or raised with respect to the outer portion 156. In an alternative embodiment, the mounting portion 152 may be at substantially the same height as the outer portion 156 or at a lower height than the outer portion 156.

Figure 6A:
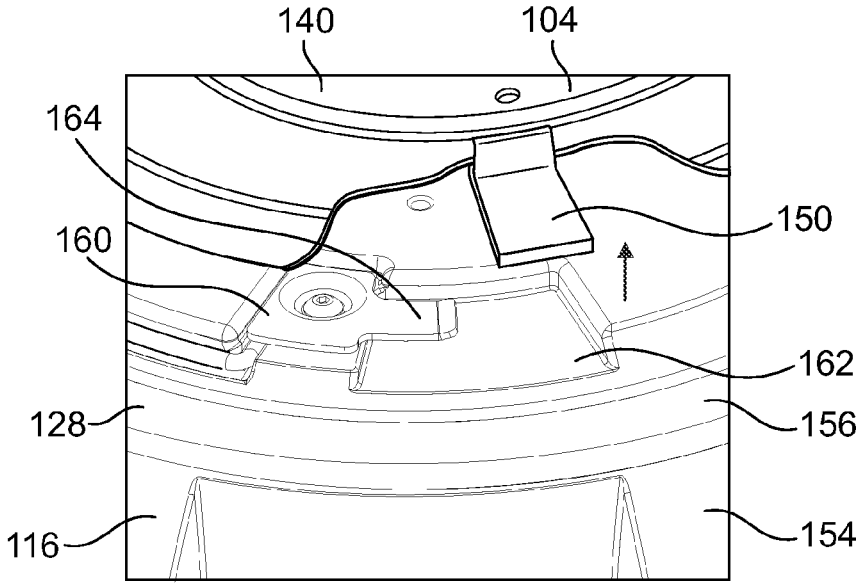
FIG. 6A is a cut away of the mounting plate and upper housing assembly separated and in alignment before locking engagement.
Figure 6B:
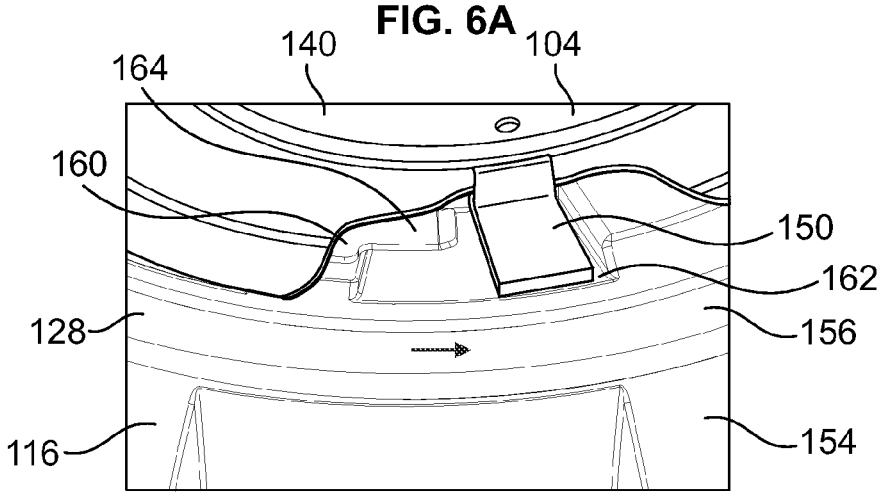
FIG. 6B is a cut away of the mounting plate and upper housing assembly together and in alignment before locking engagement.
Figure 6C:
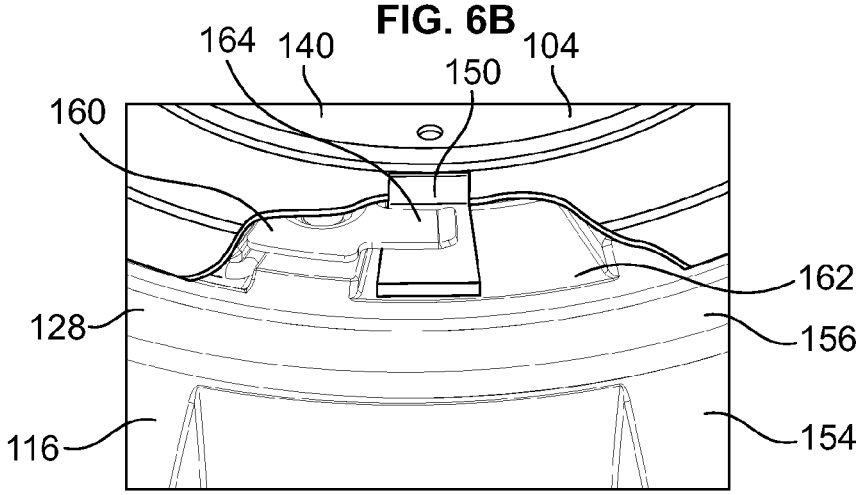
FIG. 6C is a cut away of the mounting plate and upper housing assembly after being rotated into locking engagement.

As seen in FIGS. 3 and 5, the mounting portion 152 includes mounting brackets 160 spaced at different locations. The mounting brackets 160 may be positioned at the same elevated height as the mounting portion 152. In alternative embodiments, the mounting brackets 160 may be positioned at a height between the mounting portion 152 and the outer portion 156 of the top wall 128, or at a different height. Adjacent each of the mounting brackets 160, respectively, are recessed portions 162 in the top wall 128 of the upper housing assembly 116. Each of the mounting brackets 160 has a tongue 164 that extends over a portion of a corresponding adjacent recessed portion 162. The space between each of the tongues 164 and the floor of the respective recessed portion 162 is sized such that the L-shaped extension members 150 extending from the mounting plate 104 may fit snugly therebetween. Both the mounting brackets 160 and the recessed portions 162 are positioned near the radially outward edge of the mounting portion 152 and the radially inward edge of outer portion 156. As shown in FIGS. 6A-6C, the mounting brackets 160 slide over and hang from the extension members 150 of the mounting plate 104 when the mounting portion 152 of the upper housing assembly 116 is rotatably attached to the mounting plate 104.

Referring again to FIGS. 3 and 5, the conduit 126 that receives and contains electrical wiring 109 to the lighting apparatus 100 may be positioned near the center of the mounting portion 152 of the upper housing assembly 116. The conduit 126, in this example, is a hollow cylindrical snout that extends upwards from the mounting portion 152. The entrance to the conduit 126 is thus elevated above top wall 128 of the mounting portion 152, which serves to lower the risk of liquid or other contaminants getting into the conduit 126 and damaging the electrical wiring 109 or electrical components within the lighting apparatus 100. The conduit 126 may be fitted with a grommet 166 to further limit the risk of water ingress into the conduit 126 while also further inhibiting entrance of dust and pollutants. The conduit 126, in this example, is surrounded by gasket 146. The gasket 146 serves to seal the connection between the mounting plate 104 and the mounting portion 152 of the upper housing assembly 116 so as to still further limit the risk of water, dust, and pollutant ingress into the conduit 126 and lighting apparatus 100. The conduit 126 is sized and configured to extend through the channel 142 in the mounting plate 104 when the mounting portion 152 and mounting plate 104 are placed in a locking arrangement.

The upper housing assembly 116 has a handle 168 that is hingedly attached to the top wall 128 of the upper housing assembly 116. The handle 168, in this example, is formed in a semicircle, and is attached to the top wall 128 at two hinges 170 on opposite ends of the top wall 128. The hinges 170 are positioned near the radially outward edge of the mounting portion 152 and the radially inward edge of the outer portion 156. The handle 168 is rotatable about a hinge axis perpendicular to a longitudinal axis of the lighting apparatus 100. A pocket 176 is formed in the top wall 128 of the upper housing assembly 116 to house the handle 168. As such, the pocket 176 is positioned near the radially outward edge of the mounting portion 152 and the radially inward edge of the outer portion 156. The handle 168 is rotatable from a housed position within the pocket 176 to a deployed position outside of the pocket 176, as may be seen with reference to FIG. 8.

Referring again to FIGS. 3 and 5, the locking bracket 134 attached to the upper housing assembly 116 is preferably formed of a resilient material. The locking bracket 134 may, for example, be made of a flexible metal. Alternatively, the locking bracket 134 may be made of a flexible plastic or some other resilient material. In this example, the locking bracket 134 is attached to the upper housing assembly 116 via screws 136. Alternatively, the locking bracket 134 may be attached via one or more magnets, adhesive, nuts, bolts, or other attachment mechanisms known to those of ordinary skill in the art. The locking bracket 134, in this example, is attached to the sidewall 154 and the top wall 128 of the upper housing assembly 116. Alternatively, the locking bracket 134 may be attached to just the sidewall 154 or just the top wall 128. The locking bracket 134 extends into a space 178 in the mounting portion 152. The locking bracket 134 may be able to move up and down within the space 178 about a hinge point 180 outside of the space 178. The locking bracket 134 is configured to resiliently snap within and extend into the locking opening 138 formed in the edge of the mounting plate 104 (FIG. 3) when the lighting apparatus 100 is rotatably attached into a locking arrangement with the mounting plate 104 in order to prohibit the lighting apparatus 100 from being removed from the mounting plate 104.

Figure 8:
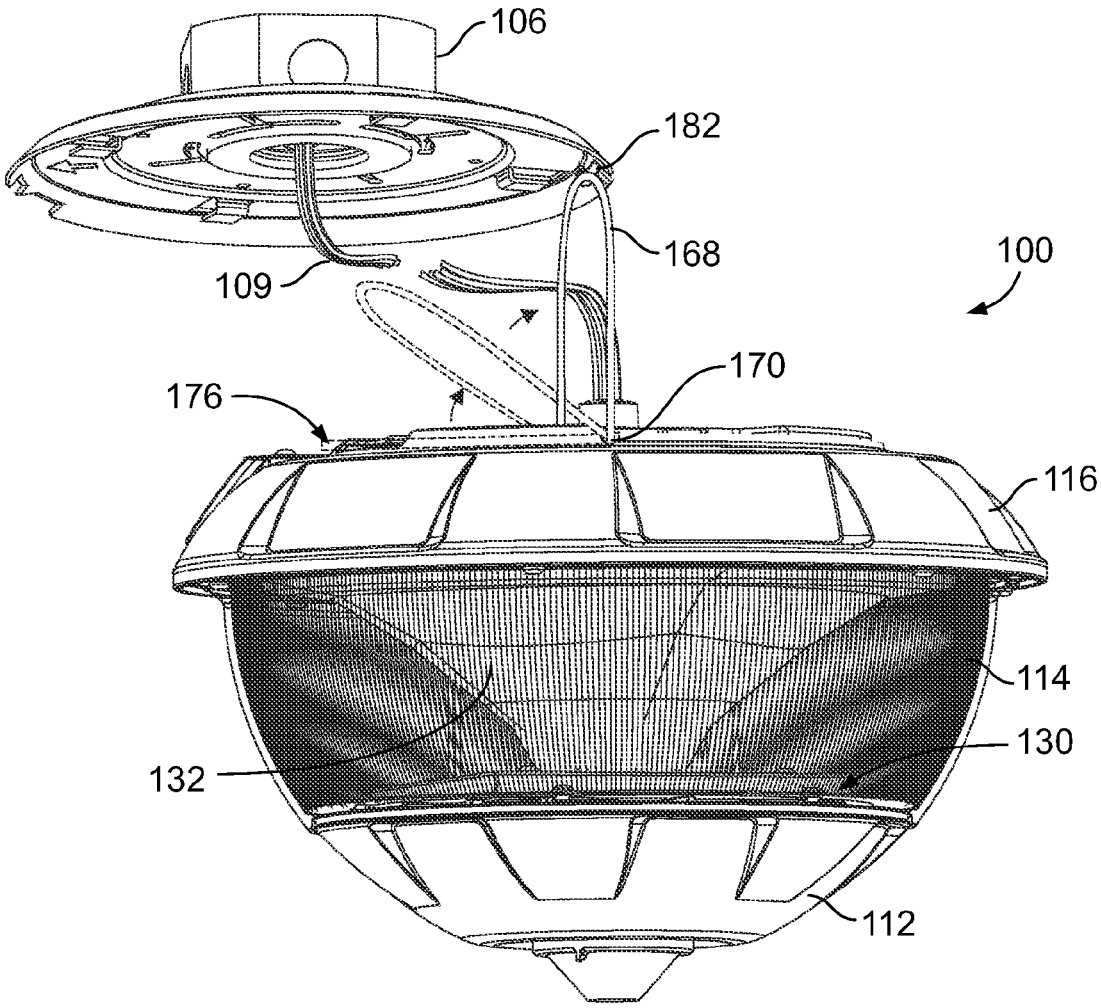
FIG. 8 is a lower perspective view of the lighting apparatus hung on the mounting plate.
Figure 9:
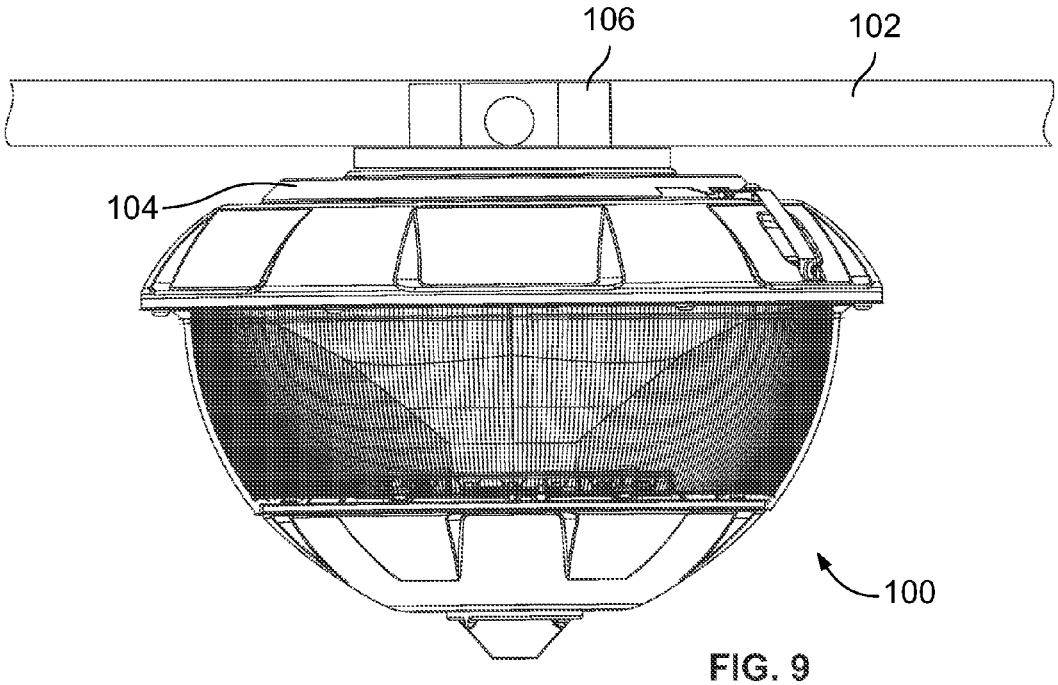
FIG. 9 is a front plan view of the lighting apparatus of FIG. 1 secured to a junction box positioned in a ceiling support structure.

As shown in FIGS. 4 and 8, the bottom face 148 of the mounting plate 104 includes a hook 182. With the mounting plate 104 attached to the junction box 106 and the junction box 106 securely mounted to the ceiling 102, wall, or other support structure, the handle 168 of the lighting apparatus 100 may be hung from the hook 182 extending from the bottom face 148 of the mounting plate 104 when the handle 168 is in the deployed position, as seen in FIG. 8. While the lighting apparatus 100 is hung by handle 168 on the hook 182 of the mounting plate 104, wiring between the electrical wires 109 of the junction box 106 and the lighting apparatus 100 may be accomplished without additional support of the lighting apparatus 100. In an alternative embodiment, the handle 168 may be hung from extension members 150 having an alternative "J" shape, for example, instead of, or as well as, the hook 182.

As shown in FIG. 4, the mounting plate 104 further includes an indicator 184 showing how to orient and align the mounting plate 104 with the mounting portion 152 of the upper housing assembly 116 before rotatably locking the two together. The indicator 184 may be an arrow as shown in FIG. 4. Alternatively, the indicator 184 may be a color coding, a graphic, a dot or line arrangement, or any other indicator as known to those of ordinary skill in the art. As seen in FIG. 5, the mounting portion 152 of the upper housing assembly 116 includes a corresponding indicator 186 to assist an installer or other user with the orientation and alignment of the mounting plate 104 and mounting portion 152 during attachment. An arrow, or some other alternative indicator, may be placed on the bottom face 148 of the mounting plate 104, for example, to indicate the direction a lighting fixture will be oriented to ensure light distribution is positioned correctly, as needed.

Figure 7C:
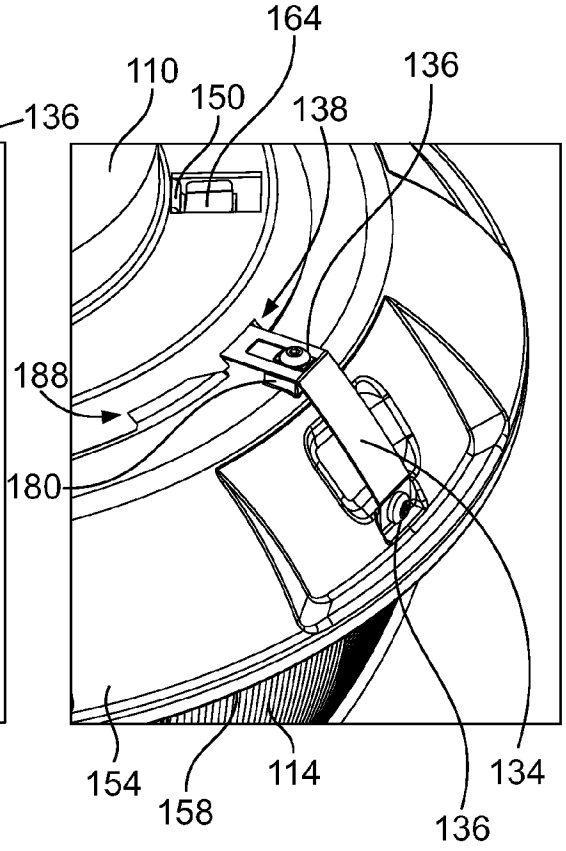
FIG. 7C is a cut away of the locking bracket extending into a locking opening of the mounting plate such that the lighting apparatus is prevented from being rotatably removed from the mounting plate when in the locking engagement position.

As seen, a dual mounting and locking system is provided in which mounting of the lighting apparatus 100 and securely locking the lighting apparatus 100 in place to a mounting plate 104 are simultaneously performed in response to a short rotational turn of the lighting assembly. In operation, an installer may align the mounting portion 152 of the lighting apparatus 100 with the mounting plate 104. When properly oriented, the indicator 184 on the mounting plate 104 should align with the matching indicator 186 on the mounting portion 152. With the indicators 184, 186 properly aligned, the extension members 150 extending from the mounting plate 104 should align with corresponding recessed portions 162 in the mounting portion 152 of the upper housing assembly 116, as seen, for example, in FIG. 6A. After proper orientation and alignment, the mounting portion 152 of the lighting apparatus 100 may be placed flush against the mounting plate 104. If properly oriented and aligned, each of the four extension members 150 of the mounting plate 104 should be seated in one of the four recessed portions 162 in the mounting portion 152 of the lighting apparatus 100. As seen in FIG. 6B, when the mounting portion 152 and mounting plate 104 are properly aligned and placed flush against one another, extension member 150 is seated in corresponding recessed portion 162 of the upper housing assembly 116. If properly oriented and aligned, the locking bracket 134 will be positioned into a cammed or ramped opening 188 of the mounting plate 104, as shown in FIG. 7A, if not properly oriented and aligned, the extension members 150 of the mounting plate 104 may abut one of the mounting brackets 160 in the mounting portion 152 of the upper housing assembly 116, or the extension members 150 of the mounting plate 104 may abut the raised mounting portion 152 itself, thereby preventing flush contact between the mounting plate 104 and mounting portion 152 of the upper housing assembly 116.

As may be seen in FIGS. 6B and 6C, once the extension members 150 are seated in their respective recesses 162, an installer need only twist or rotate the lighting apparatus 100 in the appropriate direction to lock the mounting portion 152 of the lighting apparatus 100 to the mounting plate 104. As shown in FIG. 6B, the appropriate direction in this example is counterclockwise. A short partial turn, such as a quarter-turn or less, in a counterclockwise direction, may be used, for example, when installing the lighting apparatus 100. In other embodiments, the lighting apparatus 100 may be rotated in the clockwise direction to bring it into a locking arrangement with the mounting plate 104. In either case, appropriate rotation of the lighting apparatus 100 after alignment with the mounting plate 104 will bring the extension members 150 that extend from the mounting plate 104 underneath the respective tongues 164 of the mounting brackets 160 in the mounting portion 152 of the upper housing assembly 116. Thereafter, each of the tongues 164 of the mounting brackets 160 will rest on to top of corresponding extension members 150 of the mounting plate 104 and the weight of the lighting apparatus 100 will be born by the extension members 150, as seen, for example, in FIG. 6C. Alternative embodiments to the mounting arrangements using mounting brackets, recessed areas and extension members shown in the example in FIGS. 1-6 may selectively be employed. For instance, interlocking male/female connections such as a tab and slot combination, a snap fit, tongue and groove, or a screw and thread combination are alternative examples that may selectively be used.

Figure 7B:
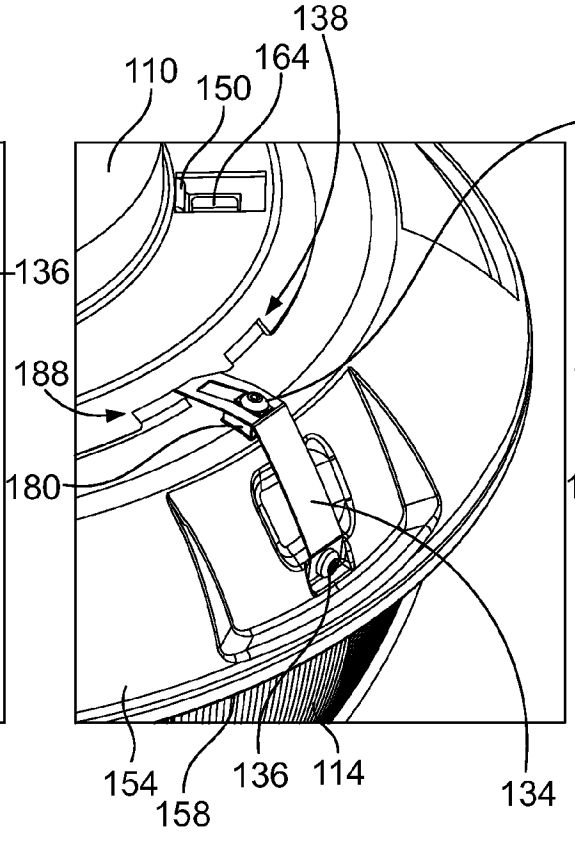
FIG. 7B is a cut away of the locking bracket being pinched between the mounting plate and the upper housing assembly during rotation of the lighting apparatus into locking engagement with the mounting plate.
Figure 7A:
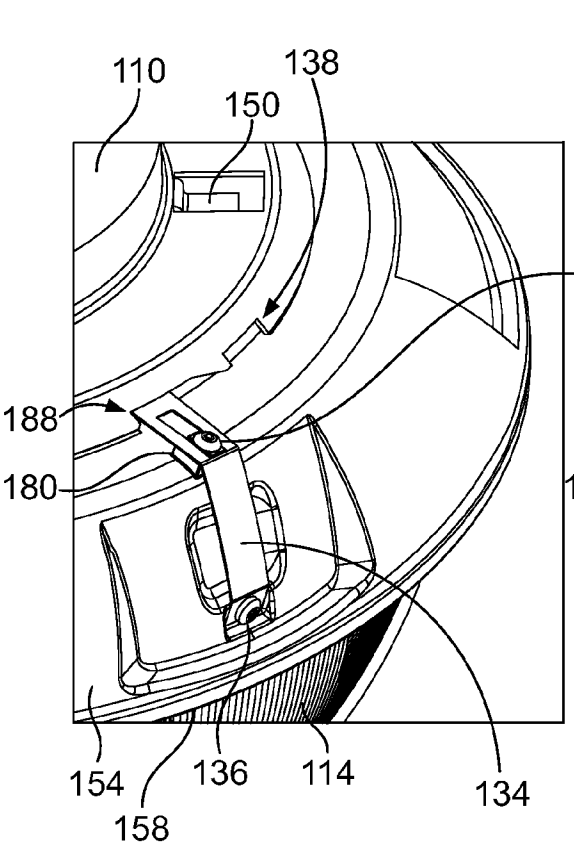
FIG. 7A is a cut away of a locking bracket extending into a ramped opening of the mounting plate when the mounting plate and a mounting portion of the lighting apparatus are properly aligned but prior to a locking engagement position.

As seen, for example, in FIG. 7B, the caromed or ramped portion of the ramped opening 188 at the edge of the mounting plate pushes the resilient locking bracket 134 down about its pivot point 180 within the space 178 of the mounting portion 152 of the upper housing assembly 116 when the lighting apparatus 100 is rotated into a locking arrangement with the mounting plate 104. The locking bracket 134 bends about the pivot point 180 and becomes pinched between the mounting plate 104 and the mounting portion 152 of the lighting apparatus 100, as shown in FIG. 7B. Further rotation of the lighting apparatus 100 brings the locking bracket 134 into alignment with the locking opening 138 of the mounting plate 104, at which point the locking bracket 134 may spring back up and extend into the locking opening 138 at the edge of the mounting plate 104 in its normal orientation, as seen, for example, in FIG. 7C.

While the locking bracket 134 is in the locking opening 138 of the mounting plate 104, as seen, for example, in FIG. 7C, the lighting apparatus 100 is substantially prevented from rotation with respect to the mounting plate 104. This prevents the lighting apparatus 100 from being accidentally removed from the mounting plate 104. Any attempted rotation will bring the locking bracket 134 into abutting contact with the mounting plate 104. In order to remove the lighting apparatus 100 from the mounting plate 104, the locking bracket 134 may be unscrewed from the upper housing assembly 116. Alternatively, a top portion of resilient locking bracket 134 may be slid out away from the locking opening 138. The top portion of locking bracket 134 may be pinched down and slid back along a groove to pull the locking bracket 134 away from the locking opening 138 allowing for rotation of the upper housing assembly 116 providing the ability to unlock with ease during removal or uninstallment of the lighting apparatus 100. In other alternative embodiments, the locking bracket 134 may be attached to the upper housing assembly with a spring loaded bolt or some other mechanism that does not require a separate tool to remove. Alternative embodiments to the locking mechanism using a locking bracket and mounting plate opening arrangement shown in the example in FIGS. 7A-7C may selectively be employed. For instance, locking through interlocking male/female connections such as a tab and slot combination, snap fit, tongue and groove, or a screw and thread combination are alternative examples that may selectively be used.

Once the locking bracket 134 is removed, the lighting apparatus 100 may be removed from the mounting plate 104 by proper rotation. In this example, the upper housing assembly 116 may be rotated clockwise to remove the lighting apparatus from the mounting plate 104. A short partial turn, such as a quarter-turn or less, may be used, for example, when removing the lighting apparatus. When properly rotated, the tongues 164 of the mounting brackets 160 will move away from engagement with the respective extension members 150 of the mounting plate 104, and the extension members 150 will be seated in respective recessed portions 162 of the mounting portion 152. Thereafter, the lighting apparatus 100 is able to be removed and moved away from the mounting plate 104.

Upon removal, the handle 168 of the lighting apparatus 100 may be removed from its housed position in the pocket 176 and put in a deployed position. After the handle 168 is in the deployed position, the lighting apparatus may be hung by the handle 168 from the hook 182 extending from the bottom face 148 of the mounting plate 104, as seen in FIG. 8. With the lighting apparatus 100 independently suspended from the hook 182 by the handle 168, an installer is able to perform maintenance or installation activities involving the lighting apparatus 100, the electrical components of the lighting apparatus 100, the electrical wiring 109, and the mounting and locking system 101.

As seen, the dual mounting and locking mechanism arrangement in the example lighting apparatus of FIGS. 1-7 provides for ease of installation to a mounting plate or another structure by simply aligning and slightly turning the lighting apparatus. Mounting and locking the lighting apparatus in place to the mounting plate are achieved simultaneously with a short rotational turn of the lighting apparatus. The locking mechanism may be easily released or removed from engagement with the mounting plate providing for quick detachment of the lighting assembly for maintenance, uninstallation, or replacement operations upon a short rotational turn of the lighting apparatus in a reverse direction. Installation of the lighting apparatus 100 to a support structure 102 may be performed by securing the mounting plate 104 (e.g. by screws) to a junction box 106. The mounting portion 152 of the upper housing assembly 116 is rotated in one direction (e.g. counterclockwise) to mount the mounting portion 152 to the mounting plate 104. A locking mechanism (e.g. locking bracket 134 or other suitable locking mechanism) is moved to a locked position as seen, for example, in FIGS. 7A-7C when the upper housing assembly 116 is rotated to mount the mounting portion 152. By rotationally turning the upper housing assembly 116, mounting of the mounting portion 152 to the mounting plate 104 and placement of the locking mechanism in the locked position are performed simultaneously.

In this example, installation of the lighting apparatus 100 may include rotationally moving the locking mechanism 134 into engagement with an opening 138 of the mounting plate 104 to substantially prevent further rotation of the upper housing assembly 116 when the locking mechanism is moved to the locked position (see FIGS. 7A-7C). To remove the lighting apparatus 100, the locking mechanism may be slid back away from the opening 138 or releasably removed from the upper housing assembly to move the locking mechanism 134 to an unlocked position. The locking bracket 134 may be pulled away from the locking opening 138 in the mounting plate 104 to disengage the locking bracket 134 from the mounting plate 104 when moving the locking bracket to the unlocked position. The upper housing assembly 116 is then turned slightly for rotation in the opposite direction (e.g. clockwise) from the counter-clockwise directional turn used to mount the lighting apparatus. After rotation of the upper housing assembly 116 in the opposite direction, the mounting portion 152 becomes disengaged from the mounting plate 104. The handle 168 at the upper housing assembly 116 may be moved to the deployed position (see FIG. 8) after the mounting assembly is disengaged from the mounting plate 104. The handle 168 may be hung from hook 182 at the bottom face 148 of the mounting plate 104 to suspend the lighting apparatus 100 from the hook 182.

As seen in the example embodiment in FIGS. 3-6, the mounting portion 152 is positioned at the top wall 128 of the upper housing assembly 116, and during installation the mounting portion 152 at the top wall 128 is inserted into engagement with the bottom face 148 of the mounting plate 104. In this example embodiment, extension members 150 extend from the bottom face 148 of the mounting plate 104. The mounting portion 152 at the upper housing assembly 116 top wall 128 has mounting brackets 160 in which each mounting bracket extends over a portion of respective recessed portions 162 of the top wall 128 surface. During installation, the upper housing assembly 116 is lifted to engage the mounting portion 152 with the bottom face 148 of the mounting plate 104 such that the extension members 150 of the mounting plate 104 sit in corresponding recessed portions 162 of the upper housing assembly 116. The mounting portion 152 is rotated to slide the mounting brackets 160 over the extension members 150 allowing the upper housing assembly 116 to be suspended by the extension members 150 of the mounting plate 104.

The LED-based lighting apparatus 100, as shown in FIGS. 1-3, may be used to illuminate a broad area while minimizing the effect of glare, for example in a parking garage. The lighting apparatus preferably houses many LEDs positioned on an LED plate held at the lower housing assembly of the lighting apparatus. Example embodiments of the lighting apparatus may emit in a range between 2,600 and 5,700 lumens. To determine performance parameters of a lighting apparatus, various application spacings may be used such as: 30'×30'×9' and 2.5' from a wall or ceiling; 40'×25'×9' and 1' from a wall or ceiling; and/or 57'×30'×10' and 1' from a wall or ceiling. In one example, the lighting apparatus 100 may be able to emit in the range of 5000 initial source lumens and 3750 delivered lumens or more. The lighting apparatus 100 may be configured for 42 watts and 89 lumens per watt (LPW). Alternatively (or additionally), the lighting apparatus 100 may be configured for 44 watts and 85 LPW. Other alternative embodiments may range between 40 and 50 watts and 80 and 95 LPW. The lighting apparatus 100 may have a color rending index (CRI) of 70 with an alternative range of 60-80 CRI with correlated color temperatures having a range of 4000 Kelvin (K) to 5700 K. The lighting apparatus 100 may have 75% optical efficiency with a 75 degree main beam. 70%-80% optical efficiency with a 70-80 degree main beam may also be achieved. The lighting apparatus 100 may use XP-G2 LEDs, for example, with small dome and 10-20 degree optics. Various embodiments of lighting apparatus 100 may selectively use between 30-40 LEDs providing between 5,000-5,100 source lumens and 78 to 90 LPW. In testing using 40 LEDs, a 57×30×10 ft layout and calculated from a point 1 foot from a wall or ceiling, for example, the lighting apparatus 100 was found to have an average foot candle (FC) of 1.5, a maximum FC of 2.5, a minimum FC of 1.1, an average/minimum of 1.4, a maximum/minimum (<10) of 2.3, a maximum Cd of 1560, and a maximum Cd angle of 45H, 75 V. In alternative examples, a 1.0-2.5 foot candle range may be employed.

Alternative embodiments of the LED-based lighting apparatus using the alternative reflector arrangements may also be employed, for example, for upgrades or retrofits. Application spacing may selectively be 30'×30'×9' and 2.5' from a wall or ceiling; 40'×25'×9' and 1' from a wall or ceiling, and/or 57'×30'×10' and 1' from a wall or ceiling. Alternative embodiments of the lighting apparatus may be able to emit in the range of 3500 initial source lumens and 2600 delivered lumens, or more. Alternative lighting apparatus may be configured for 28 watts and 93 LPW. Alternatively (or additionally) the alternative lighting apparatus may be configured for 30 watts and 90 LPW. A range of 25-35 watts and 85-98 LPW may be employed. Alternative embodiments of the lighting apparatus may have a CRI range of 60-80 with correlated color temperatures ranging from 4000 K to 5700 K with a 70%-80% optical efficiency with a 50-60 degree main beam, XP-G2 LEDs may be used with small dome and 10-20 degree optics. Various alternative lighting apparatus embodiments may selectively use between 30-40 LEDs providing between 3,500-3,600 source lumens and 85-96 LPW. In testing using 40 LEDs, a 30×30×9 ft layout and calculated from a point 2.5 feet from a wall or ceiling, example embodiments of the lighting apparatus were found to have an average foot candle (FC) of 2.4, a maximum FC of 3.5, a minimum FC of 1.0, an average/minimum of 2.4, a maximum/minimum (<10) of 3.5, a maximum Cd of 457, and a maximum Cd angle of 15H, 60V. In alternative examples, a 2.0-4.0 foot candle range may be employed.

Various embodiments of the lighting apparatus may have a type V distribution with 5%-15% uplight. The glare control for the various embodiments may be <5,5000 cd/m2 measured from a 55 degree angle from Nadir, <3,860 cd/m2 measured from a 65 degree angle from nadir, <2,570 cd/m2 measured from a 75 degree angle from nadir, and/or <1,695 cd/m2 measured from an 85 degree angle from nadir.

While particular elements, embodiments, and applications of the present invention have been shown and described, it is understood that the invention is not limited thereto because modifications may be made by those skilled in the art, particularly in light of the foregoing teaching. It is therefore contemplated by the appended claims to cover such modifications and incorporate those features which come within the spirit and scope of the invention.

We claim:

1. A lighting apparatus, comprising:

an upper housing assembly having a top wall and at least one sidewall; the upper housing assembly is configured such that electrical wiring is adapted to exit the lighting apparatus through the upper housing assembly;

at least one additional housing assembly positioned below and secured to the upper housing assembly;

a mounting portion at the top wall of the upper housing assembly wherein the mounting portion is configured to rotatably attach to a mounting plate wherein the mounting portion includes mounting brackets configured to slide over and hang from extension members extending from the mounting plate when the mounting portion is rotatably attached to the mounting plate: and a locking bracket attached to the upper housing assembly, wherein the locking bracket is configured to extend into an opening of the mounting plate when the mounting portion of the upper housing assembly is attached to the mounting plate such that the locking bracket substantially prevents further rotation of the upper housing assembly with respect to the mounting plate when the locking bracket extends into the opening of the mounting plate.

2. The lighting apparatus of claim 1, wherein the at least one additional housing assembly further comprises a lower housing assembly secured to a middle housing assembly, wherein the middle housing assembly is secured to the upper housing assembly, and wherein the lower housing assembly holds a plurality of light emitting diodes (LEDs), the middle housing assembly includes an outer lens configured to focus light emitted from the LEDs, and the upper housing assembly houses electrical components coupled to electrical wiring that extends through a conduit of the upper housing assembly.

3. The lighting apparatus of claim 2, wherein the lighting apparatus is adapted to emit between 2,600-5,700 lumens.

4. The lighting apparatus of claim 1, wherein the mounting portion of the upper housing assembly further includes recessed portions, and wherein the mounting brackets are positioned adjacent to respective recessed portions.

5. The lighting apparatus of claim 4, wherein each of the mounting brackets includes a tongue that extends over a portion of the adjacent respective recessed portions.

6. The lighting apparatus of claim 5, wherein the extension members are L-shaped members extending from a bottom face of the mounting plate, and wherein the tongues of the mounting brackets are configured to slide over a portion of the L-shaped members extending from the mounting plate when the L-shaped members are positioned to sit in the recessed portions and the mounting portion is subsequently rotated.

7. The lighting apparatus of claim 5, wherein the top wall further includes an outer portion, and wherein the mounting portion is elevated above the outer portion.

8. A mounting and locking system for a lighting apparatus configured to be attached to an electrical junction box connected to a ceiling or wall, comprising:

a mounting plate having a plurality of extension members extending from a bottom face of the mounting plate; and a lighting apparatus having:

an upper housing assembly, at least one additional housing assembly positioned below and secured to the upper housing assembly, the upper housing assembly having a top wall and at least one sidewall, the top wall including a mounting portion having a plurality of mounting brackets, wherein the mounting brackets are configured to attach to respective extension members when the lighting apparatus is rotated into a locking arrangement with the mounting plate, and a locking bracket attached to the upper housing assembly wherein the locking bracket is configured to extend into an opening of the mounting plate when the mounting portion of the upper housing assembly is rotatably attached to the mounting plate such that the locking bracket substantially prevents further rotation of the lighting apparatus with respect to the mounting plate when the locking bracket extends into the opening of the mounting plate.

9. The system of claim 8, wherein the lighting apparatus houses a plurality of light emitting diodes (LEDs) and wherein the lighting apparatus is adapted to emit between 2,600-5,700 lumens.

10. The system of claim 8, wherein the mounting portion further includes recessed portions, wherein the mounting brackets are attached adjacent to respective recessed portions, wherein each of the mounting brackets include a tongue that extends over a portion of the respective recess, and wherein the tongues of the mounting brackets are configured to slide over the extension members when the extension members sit in the recessed portions and the lighting apparatus is subsequently rotated into locking arrangement with the mounting plate.

11. The method of claim 10, wherein the lighting apparatus houses a plurality of light emitting diodes (LEDs) such that the lighting apparatus is adapted to emit between 2,600-5,700 lumens.

12. A method of installing a lighting apparatus to a support structure, comprising:

aligning a mounting portion of an upper housing assembly of the lighting apparatus with a mounting plate;

rotating the upper housing assembly in one direction to mount the mounting portion to the mounting plate;

moving a locking mechanism to a locked position when the upper housing assembly is rotated to mount the mounting portion;

moving the locking mechanism to an unlocked position; and rotating the upper housing assembly in an opposite direction to the one direction to disengage the mounting portion from the mounting plate.

13. The method of claim 12, wherein the steps of rotating the upper housing assembly and moving the locking mechanism to the locked position are performed simultaneously.

14. The method of claim 13, wherein the step of moving the locking mechanism further comprises rotationally moving the locking mechanism into engagement with an opening of the mounting plate to substantially prevent further rotation of the upper housing assembly when the locking mechanism is moved to the locked position.

15. The method of claim 13, wherein the locking mechanism comprises a locking bracket attached to the upper housing assembly, and wherein the step of moving to the unlocked position further comprises pulling the locking bracket away from the opening in the mounting plate to disengage the locking bracket from the mounting plate.

16. The method of claim 13, wherein the mounting portion is at a top wall of the upper housing assembly, and further comprising inserting the mounting portion at the top wall of the upper housing assembly into engagement with a bottom face of the mounting plate.

17. The method of claim 16, wherein the mounting plate has a plurality of extension members extending from the bottom face of the mounting plate, the mounting portion includes a plurality of mounting brackets that each extend over a portion of respective recessed portions of the mounting portion, and further comprising:

lifting the upper housing assembly to engage the mounting portion with the bottom face of the mounting place such that the extension members of the mounting plate sit in corresponding recessed portions of the upper housing assembly; and rotating the mounting portion to slide the mounting brackets over the extension members allowing the upper housing assembly to be suspended by the extension members of the mounting plate.

18. A lighting apparatus, comprising:

an upper housing assembly having a top wall and at least one sidewall, the upper housing assembly is configured such that electrical wiring is adapted to exit the lighting apparatus through the upper housing assembly;

at least one additional housing assembly positioned below and secured to the upper housing assembly; and a mounting portion at the top wall of the upper housing assembly wherein the mounting portion is configured to rotatably attach to a mounting plate, and wherein the upper housing assembly further includes a handle that is hingedly attached at opposite ends of the top wall.

19. The lighting apparatus of claim 18, wherein the top wall further includes a pocket that receives the hinged handle when the hinged handle is in a housed position.

20. The lighting apparatus of claim 18, wherein the handle is configured to rotate from a housed position to a deployed position, and wherein the handle is configured to hang from a hook extending from the mounting plate when in the deployed position.

21. A mounting and locking system for a lighting apparatus configured to be attached to an electrical junction box connected to a ceiling or wall, comprising:

a mounting plate having a plurality of extension members extending from a bottom face of the mounting plate; and a lighting apparatus having:

an upper housing assembly, and at least one additional housing assembly positioned below and secured to the upper housing assembly, the upper housing assembly having a top wall and at least one sidewall, the top wall including a mounting portion having a plurality of mounting brackets, wherein the mounting brackets are configured to attach to respective extension members when the lighting apparatus is rotated into a locking arrangement with the mounting plate, and wherein the lighting apparatus further comprises a handle that is hingedly attached at opposite ends of the top wall.

22. The system of claim 21, wherein the handle is rotatable from a housed position to a deployed position, and wherein a pocket is formed in the top wall of the upper housing assembly that receives the handle when the handle is in a housed position.

23. The system of claim 21, wherein the mounting plate is securable to the electrical junction box, and wherein the extension members of the mounting plate are L-shaped members extending from the bottom face of the mounting plate.

24. The system of claim 23, further comprising at least one hook extending from the bottom face of the mounting plate, wherein the hook is configured to receive the handle allowing the lighting apparatus to be hung from the hook such that electrical wiring between the junction box and the lighting apparatus may be accomplished without additional support of the lighting apparatus.

25. A method of installing a lighting apparatus to a support structure, comprising:

aligning a mounting portion of an upper housing assembly of the lighting apparatus with a mounting plate;

rotating the upper housing assembly in one direction to mount the mounting portion to the mounting plate;

moving a locking mechanism to a locked position when the upper housing assembly is rotated to mount the mounting portion;

moving a handle at the upper housing assembly to a deployed position after the mounting portion is disengaged from the mounting plate.

* * * * *